US012193477B2

(12) United States Patent
Pastore et al.

(10) Patent No.: US 12,193,477 B2
(45) Date of Patent: Jan. 14, 2025

(54) DEVICE AND METHOD FOR COMBINING FILTER SEGMENTS WITH CIGARETTE ROD SEGMENTS IN A MACHINE FOR MAKING CIGARETTES

(71) Applicant: G.D S.p.A., Bologna (IT)

(72) Inventors: Fulvio Pastore, Bologna (IT); Nicola Rizzo, Bologna (IT); Gabriele Benni, Bologna (IT); Giuliano Gamberini, Bologna (IT); Luca Federici, Bologna (IT)

(73) Assignee: G.D S.P.A., Bologna (IT)

( * ) Notice: Subject to any disclaimer, the term of this patent is extended or adjusted under 35 U.S.C. 154(b) by 601 days.

(21) Appl. No.: 17/425,759

(22) PCT Filed: Feb. 11, 2020

(86) PCT No.: PCT/IB2020/051070
§ 371 (c)(1),
(2) Date: Jul. 26, 2021

(87) PCT Pub. No.: WO2020/165752
PCT Pub. Date: Aug. 20, 2020

(65) Prior Publication Data

US 2022/0160020 A1 May 26, 2022

(30) Foreign Application Priority Data

Feb. 12, 2019 (IT) ..... 102019000002025

(51) Int. Cl.
*A24C 5/47* (2006.01)

(52) U.S. Cl.
CPC ..... *A24C 5/472* (2013.01); *A24C 5/478* (2013.01)

(58) Field of Classification Search
None
See application file for complete search history.

(56) References Cited

U.S. PATENT DOCUMENTS 3,483,873 A 12/1969 Hinzmann
3,527,234 A 9/1970 Hinzmann
(Continued)

FOREIGN PATENT DOCUMENTS

DE 1192570 B 5/1965
EP 1240834 A2 9/2002
(Continued)

OTHER PUBLICATIONS

International Search Report and Written Opinion dated May 13, 2020 from counterpart International Patent Application No. PCT/IB2020/051070.
(Continued)

*Primary Examiner* — Philip Y Louie
*Assistant Examiner* — Madeleine P Delacruz
(74) *Attorney, Agent, or Firm* — SHUTTLEWORTH & INGERSOLL, PLC; Timothy J. Klima

(57) ABSTRACT

A device for combining filter segments with cigarette rod segments includes a first feed device for feeding a succession of gummed connecting strips and a second feed device for feeding a succession of groups, each including at least one cigarette rod segment and one filter segment, abutted end to end. A combining conveyor receives the groups in a first receiving station and the succession of strips in a second receiving station downstream of the first receiving station so that each gummed connecting strip is applied in flag-like manner on a respective group to connect the cigarette rod segment to the filter segment. A rolling drum receives the group with strip and rolls the strip round the group. A compression device downstream of the second receiving station and upstream of the release station produces compression between each group and the respective strip.

21 Claims, 7 Drawing Sheets

(56) References Cited

U.S. PATENT DOCUMENTS

| | | | | |
|---|---|---|---|---|
| 4,368,743 | A | 1/1983 | Barbe et al. | |
| 4,913,167 | A | 4/1990 | Riccardo | |
| 5,520,195 | A * | 5/1996 | Rizzoli ..... | A24C 5/471 131/94 |

FOREIGN PATENT DOCUMENTS

| | | | |
|---|---|---|---|
| EP | 2545791 | A1 | 1/2013 |
| GB | 814383 | A | 6/1959 |

OTHER PUBLICATIONS

Chinese Office Action dated Apr. 6, 2022 from counterpart Chinese Patent Application No. 202080013997.8.

* cited by examiner

DEVICE AND METHOD FOR COMBINING FILTER SEGMENTS WITH CIGARETTE ROD SEGMENTS IN A MACHINE FOR MAKING CIGARETTES

This application is the National Phase of International Application PCT/IB2020/051070 filed Feb. 11, 2020 which designated the U.S.

This application claims priority to Italian Patent Application No. 102019000002025 filed Feb. 12, 2019, which application is incorporated by reference herein.

TECHNICAL FIELD

This invention addresses the field of manufacturing of smoking articles, in particular the manufacturing of cigarettes.

More specifically, this invention relates to a device for combining filter segments with cigarette rod segments in a cigarette making machine. This invention also relates to a method for combining filter segments with cigarette rod segments.

In other words, this invention addresses the sector of machines known as "filter tip attachment machines" used in the tobacco industry, for example, to make traditional filter cigarettes—that is to say, which can be smoked by burning the end of the cigarette opposite the filter—or with other types of cigarettes such as, for example, those with NWA (non-wrapped acetate) filters. In other words, this invention relates to devices for machines used in the tobacco industry to make rod-shaped smoking articles.

BACKGROUND ART

In the context of this invention, the term "cigarette" includes products similar to cigarettes, such as, for example, cigars, cigarillos and similar filter-tipped products.

In particular, this invention regards a device operating in a machine for making cigarettes from groups comprising, at least one cigarette rod segment and one filter segment, abutted end to end and subsequently wrapped in suitable gummed connecting strips. In particular, the groups may comprise two tobacco segments which are coaxial with each other and separated by a double filter, or "simple" groups made up of a single cigarette rod segment and a respective single filter.

In particular, the connecting strips are applied to the groups by attaching them in a way that has come to be known as "flag-like manner". The expression "flag-like manner" means that the connecting strip is attached to the group only by a small part of the connecting strip itself, specifically by its leading edge.

One critical issue which affects prior art machines is precisely the way the connecting strips are applied to the respective groups and, in particular, how the groups with the connecting strips attached in this way are subsequently transported. In particular, given the fragile nature of the groups, applying the connecting strip may damage the zone of the group where the connecting strip is applied to it.

Moreover, if the connecting strip has not, for example, been applied with the correct pressure, subsequent transportation may cause the connecting strip to become detached from the group or to be displaced so that it is not in the correct position when it is subsequently rolled. In other words, when the group with the connecting strip on it is transported, the connecting strip, if it has not been glued properly to the group and/or has not been applied with sufficient pressure, may be lost or may not stick properly to the group or may move so that it is not in the right position for rolling round the group to make the cigarette.

This negative effect is particularly common when the surfaces being glued are not made exclusively of paper: for example, where at least one of the two contact surfaces comprises particularly smooth or low-porosity materials such as, for example, layers or coatings made of another material and, in particular, filters which are not wrapped in paper and which are made, for example, by steaming and known by the acronym NWA.

AIM OF THE INVENTION

In this context, the technical purpose which forms the basis of this invention is to propose a device and a method for combining filter segments with cigarette rod segments in a cigarette making machine to overcome at least some of the above mentioned disadvantages of the prior art.

More specifically, the aim of this invention is to provide a device and a method for combining at least a first segment, specifically a cigarette rod segment, with at least a second segment, specifically a filter segment, capable of securely applying the gummed connecting strips to the respective groups according to a predetermined positioning relation.

More specifically, a further aim of this invention is to provide a device and a method for combining filter segments with cigarette rod segments in a cigarette making machine capable of ensuring that the connecting strips are not detached from the respective groups of segments while they are being transported, thus avoiding the need to stop the machine.

The technical purpose and aims specified are substantially achieved by a device and a method for combining filter segments with cigarette rod segments in a cigarette making machine comprising the technical features described in one or more of the appended claims.

This invention discloses a device for combining filter segments with cigarette rod segments in a cigarette making machine. The device comprises first feed means for feeding a succession of gummed connecting strips and second feed means for feeding a succession of groups, each group comprising at least one cigarette rod segment and one filter segment abutted against each other end to end. The device also comprises a combining conveyor configured to receive the succession of groups from the second feed means in a first receiving station and to receive the succession of gummed connecting strips from the first feed means in a second receiving station located downstream of the first receiving station so that each gummed connecting strip is applied in flag-like manner on a respective group to connect the cigarette rod segment to the filter segment. The device also comprises a rolling drum which is coupled to the combining conveyor to receive from the combining conveyor, at a release station, a succession of groups, provided with gummed connecting strips applied in flag-like manner, and which is configured to roll each gummed connecting strip round the respective group. The device also comprises compression means associated with the combining conveyor and acting downstream of the second, receiving station and upstream of the release station to produce compression between each group and the respective connecting strip applied in flag-like manner, along a predetermined trajectory between the second, receiving station and the release station.

The compression means may be disposed in association with the rolling drum, hence disposed downstream of the release station.

Advantageously, the pressure exerted by the compression means allows each gummed connecting strip to adhere properly to the respective group, thus ensuring it is firmly and securely applied.

Advantageously, the compression means allow the gummed connecting strip to stick effectively to the group, preventing unwanted detachment, so that the group reaches the rolling drum in the optimum condition to be coupled (that is, rolled) in the required manner.

The compression means may comprise a pressure belt having an active section which faces the combining drum in such a way as to keep the gummed connecting strip pressed against the respective group so that after being applied to the group in the receiving station, the connecting strip remains in the same position relative to the group.

The compression means may also comprise retaining means configured to act on the pressure belt in such a way as to give the active section a predetermined configuration. This creates a compression channel capable of keeping the connecting strip pressed against the respective group in the same position as that in which it was applied on the group in the receiving station.

The compression means may also comprise a heater configured to heat the belt in order to improve adhesion of each connecting strip to the respective group.

Advantageously, the device allows strengthening the connection between the connecting strip and the group before the group and the connecting strip reach the point where they are rolled together.

This invention also discloses a method for combining filter segments with cigarette rod segments comprising the steps of making a succession of gummed connecting strips and feeding a succession of groups, each comprising at least one cigarette rod segment and one filter segment abutted end to end, towards a first receiving station of a combining conveyor. The method also comprises the steps of applying the succession of gummed connecting strips in flag-like manner on the respective groups in a second receiving station of the combining conveyor, downstream of the first receiving station, so as to join each rod segment with a filter segment. Next, the method comprises transporting a succession of groups, each provided with a connecting strip, from the second receiving station to a release station and rolling the succession of connecting strips round the respective groups.

The method comprises a step of compressing each group, with the respective gummed connecting strip on it, by means of compression means, and maintaining the compression along a predetermined trajectory from the second receiving station to the release station.

Advantageously, the method allows considerably increasing the length of time the connecting strip is pressed against the group. This strengthens the connection between the connecting strip and the group before they reach the portion of the rolling drum where they are rolled together and where the cigarette rods and the filters are finally joined together. The method allows strengthening the connection between the connecting strip and the group before the step of rolling.

The dependent claims, which are incorporated herein by reference, correspond to different embodiments of the invention.

BRIEF DESCRIPTION OF THE DRAWINGS

Further features and advantages of this invention are more apparent in the detailed description below, with reference to a preferred, but non-exclusive embodiment of a device and a method for combining filter segments with cigarette rod segments in a cigarette making machine, as illustrated in the accompanying drawings, in which.

DETAILED DESCRIPTION OF PREFERRED EMBODIMENTS OF THE INVENTION

Figure 1:
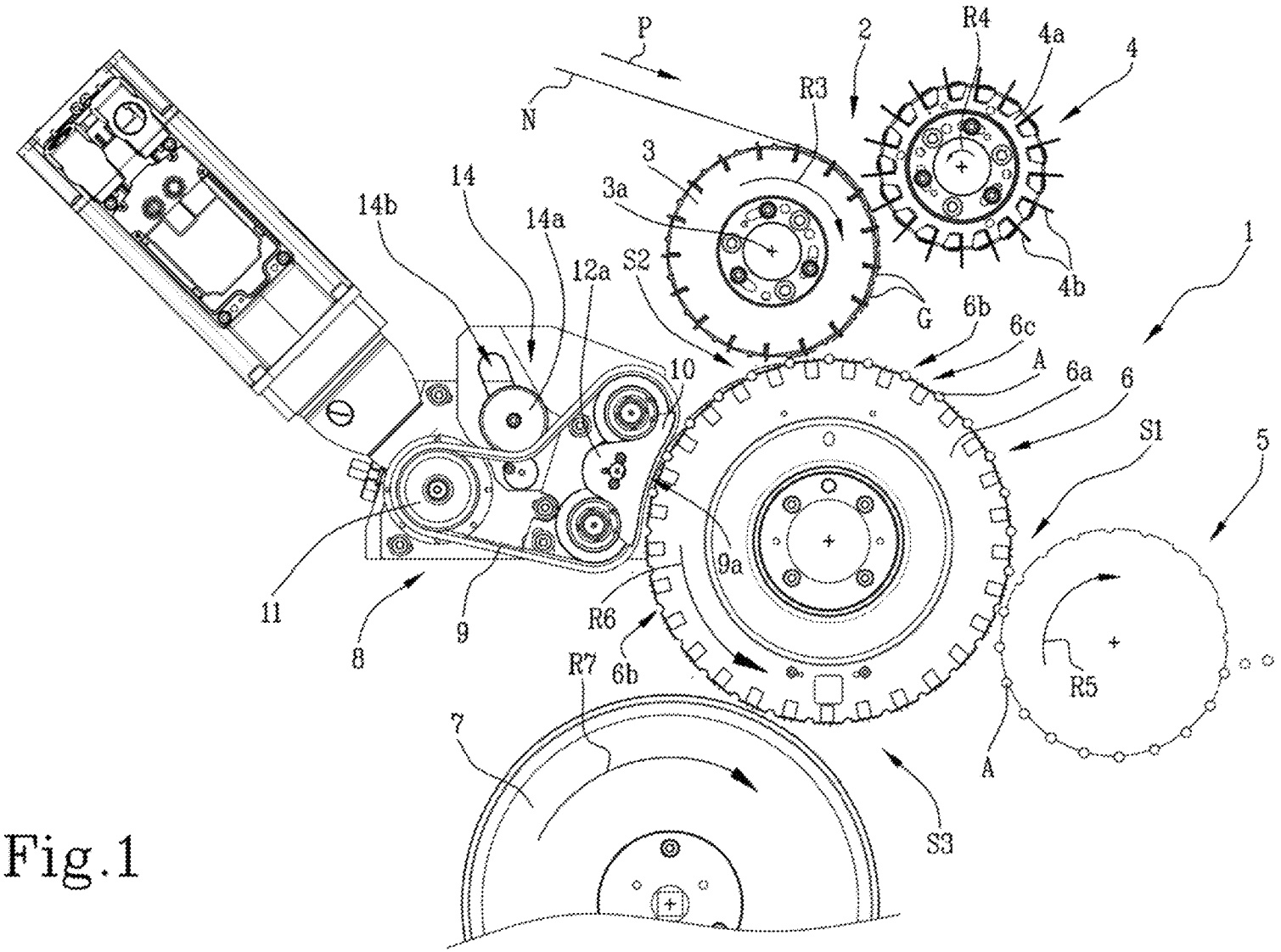
FIG. 1 schematically represents a first embodiment of a device for combining filter segments with cigarette rod segments.

With reference to the accompanying drawings, the numeral 1 denotes in its entirety a device for combining filter segments with cigarette rod segments in a filter tip attachment machine of a cigarette making system.

The term cigarettes "S" is used to denote traditional filter cigarettes—that is to say, which can be smoked by burning the end of the cigarette opposite the filter—or other types of cigarettes such as, for example, those with NWA (non-wrapped acetate) filters. In other words, the term cigarettes "S" is used, more generally, to denote rod-shaped smoking articles.

The device 1 comprises first feed means 2 for feeding a succession of gummed connecting strips G (or connecting strips G). More specifically, the first feed means 2 comprise a suction roller 3, adapted to rotate about its axis of rotation 3*a* and around which the leading end of a web N fed along a respective feed path (in the direction indicated by the arrow P) is partly wrapped. The web N is provided with a specific gumming so that it does not subsequently require gumming operations after the connecting strips G have been made. Preferably, the web N receives a gumming pattern upstream of the suction roller 3, for example by means of a specific gumming station of known type, configured to impart a desired gumming pattern provided, for example, with glue zones and no-glue zones (the latter being located, for example, to correspond to perforated zones or high-permeability zones of the connecting strip G).

The suction roller 3 rotates in the direction indicated by the arrow R3 and is adapted to hold the leading end of the web N and the sequence of connecting strips G by suction along its outside surface following the path P.

The first feed means 2 also comprise cutting means 4 configured to cut the web N cyclically and transversely in order to make a succession of gummed connecting strips G. The cutting means 4 are preferably made in the form of a cutting roller 4*a* which rotates about its axis of rotation in the direction indicated by the arrow R4 and which is provided with a plurality of blades 4*b*, circumferentially distributed and configured to cut the web N at the leading end of it to make a succession of gummed connecting strips G.

Figure 4A:
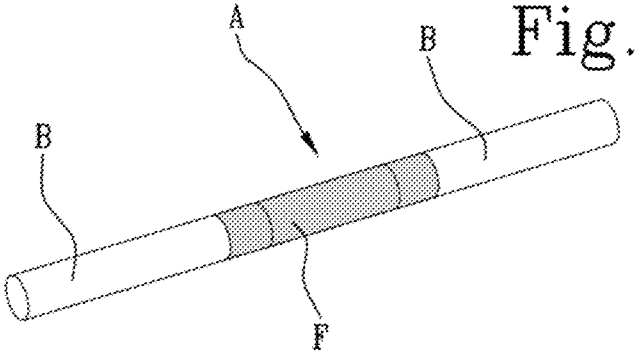
FIGS. 4A-4C schematically represent a sequence of operations hereby filter segments are combined with cigarette rod segments.

The device 1 is also provided with second feed means 5 configured to feed a succession of groups A, each comprising at least one cigarette rod segment B and one filter segment F abutted against each other end to end. Preferably, as shown in the accompanying drawings (FIGS. 4A-4C), the groups A comprise two coaxial cigarette rod segments B separated by a double filter F. The invention is, however, also applicable to groups A having a single-length cigarette rod segment B associated with a single-length filter segment F.

The invention is also applicable to groups A having at least a first rod-shaped segment B associated with at least one second rod-shaped segment. F, independently of the material they are made of.

The second feed means 5 preferably comprise an infeed roller 5*a* provided with a plurality of equispaced peripheral flutes adapted to receive and hold the aforementioned groups A (in a known manner, not illustrated). More specifically, the infeed roller 5*a* is adapted to rotate about its axis of rotation in the direction of the arrow R5.

The device 1 comprises a combining conveyor 6 configured to receive the succession of groups A from the feed means 5 in a first receiving station S1 and to receive the succession of gummed connecting strips G from a second receiving station S2 located downstream of the first receiving station S1. In other words, the feed means 5 and the combining conveyor 6 are coupled to each other.

Figure 4B:
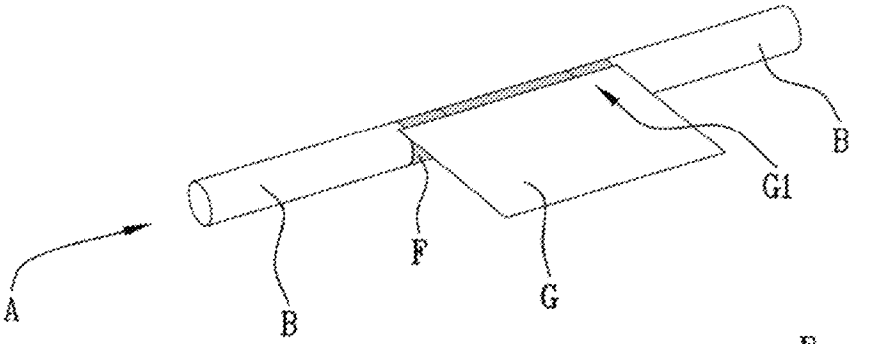

In other words, the combining conveyor 6 receives the groups A and transports them in proximity to the suction roller 3 which in turn transports the gummed connecting strips G. Thus, each gummed connecting strip G is applied in flag-like manner on a respective group A so as to join each rod segment with the filter segment F. The expression "flag-like manner" means that the gummed connecting strip G is attached to the group only by a small part of the connecting strip itself, specifically by the leading edge G1 of the connecting strip, as illustrated in FIG. 4B. The edge G1 is provided with an adhesive pattern which allows the gummed connecting strip G to be applied to the respective group A. In other words, the gummed connecting strip G is applied tangentially on the respective group A and the edge G1 is provided with adhesive material so it sticks to the respective group A.

As illustrated in the accompanying drawings, the suction roller 3 and the combining conveyor 6 face each other and are coupled in such a way as to allow coupling the gummed connecting strips G to the respective groups.

Preferably, and as illustrated in the accompanying drawings, the combining conveyor 6 is made in the form of a combining drum 6*a*. The combining drum 6*a* rotates about its axis of rotation in the direction indicated by the arrow R6. The combining drum 6*a* comprises a peripheral mantle provided with a plurality of suction flutes 6*b* for receiving respective groups A and with support sections 6*c*, alternated with successive suction flutes 6*b*, for supporting the free portions of the respective gummed connecting strips G. In other words, the portion of the gummed connecting strip G not applied on the group rests on the support sections 6*c* so that the gummed connecting strip G does not stick to the mantle of the combining drum 6*a*. The support sections 6*c* are configured to keep the free portion of the gummed connecting strips G in a raised position.

Figure 4C:
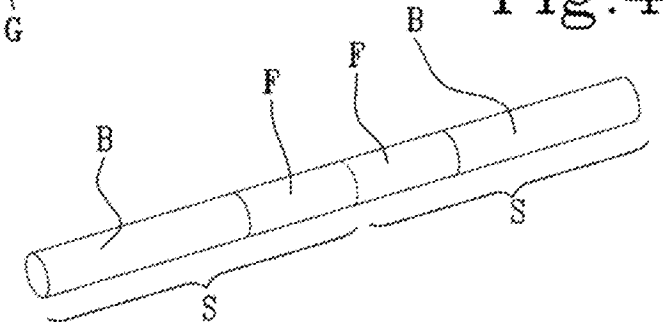

The device 1 also comprises a rolling drum 7 coupled to the combining conveyor 6 (that is, to the combining drum 6*a* as illustrated in the accompanying drawings). The rolling drum 7 is adapted to rotate about its axis of rotation in the direction indicated by the arrow R7. The rolling drum 7 is configured to receive from the combining conveyor 6 a succession of groups A, provided with gummed connecting strips G applied in flag-like manner. More specifically, the rolling drum 7 receives in a release station S3. The rolling drum 7 is configured to roll the connecting strip G round the group A. In other words, the rolling drum 7 is provided specific means (known and not illustrated) adapted to wrap (that is, to join) the gummed connecting strip G round the respective group A so as to join the at least one cigarette rod B to the respective filter F (or, as illustrated in FIG. 4C, the two cigarette rods B to the double filter F).

Advantageously, the device 1 also comprises compression means 8 associated with the combining conveyor 6 and acting downstream of the second, receiving station S2 (and preferably upstream of the release station S3), to produce compression between each group A and the respective connecting strip G applied in flag-like manner. The compression means 8 thus operate along a predetermined trajectory between the second, receiving station S2 and the release station S3. In other words, the compression means 8 operate on the above mentioned trajectory after the connecting strips G have been applied on the respective groups A and before they are released to the rolling drum 7.

In an embodiment not illustrated, the compression means 8 may be disposed in association with the rolling drum 7, hence disposed downstream of the release station S3.

Advantageously, the pressure exerted by the compression means 8 allows each gummed connecting strip G to adhere effectively to the respective group A, ensuring that application is firm and secure and accompanying the connecting strip G in its trajectory between the second receiving station S2 and the release station S3, preventing the connecting strip G from moving out of alignment with respect to the predetermined position.

The compression means 8 thus allow the gummed connecting strip G to stick effectively to the group A, preventing unwanted detachment, so that the group A reaches the rolling drum 7 in the optimum condition to be coupled according to the required configuration.

Advantageously, in the embodiments illustrated in the accompanying drawings (in which the combining conveyor 6 is in the form of the combining drum 6*a*), the joint action of the support sections 6*c* and the compression means 8 allows keeping the connecting strip G adherent to the respective group G by its edge G1 and preventing the free portion of the connecting strip G from sticking to the mantle of the combining drum 6*a*.

In the embodiment illustrated, the compression means 8 comprise a pressure belt 9 configured to keep each gummed connecting strip G pressed against the respective group A as they move along the predetermined trajectory between the receiving station S2 and the release station S3.

More specifically, as illustrated in the accompanying drawings, the pressure belt 9 has an active section 9*a* which faces the peripheral mantle of the combining drum 6*a*. In other words, the active section 9*a* is the portion of the pressure belt 9 that acts on the groups A provided with the connecting strips B: that is to say, the active section 9*a* is between the second receiving station 62 and the release station 63.

In other words, the pressure belt 9 is configured to keep each connecting strip G pressed against the respective group A for a predetermined angular part of the rotation of the combining drum 6*a*. The predetermined angular part extends between the second receiving station S2 and the release station 63. The angular part has an extension of between 10° and 160°, preferably approximately 40°.

The active section 9*a* of the pressure belt 9 has a concave configuration, with concavity facing the peripheral mantle of the combining drum 6*a* and convexity directed towards the opposite side. That way, the active section 9*a* (that is, the pressure belt 9) defines a compression channel in conjunction with the peripheral mantle. In an embodiment, the compression channel has a uniform width along the feed trajectory of the groups A provided with connecting strips B on the combining drum 6*a* so as to apply uniform compression along the entire feed trajectory. In other words, the active section 9*a* has a trajectory that is substantially concentric with the combining drum 6*a*. Advantageously, this solution is suitable for keeping the connecting strip G pressed against the respective group A in the same position as that in which the connecting strip G was applied on the group A in the receiving station S. This solution is also suitable for avoiding damage to the succession of groups A as a result of the pressure applied by the active section 9*a*.

In a different embodiment not illustrated, the pressure belt 9 may follow a feed path such as to apply compression to different degrees on the groups A provided with connecting strips B along the active section 9*a*. In other words, the compression channel, in this case, decreases in width along the feed trajectory in such a way as to progressively increase the pressure applied along the feed trajectory.

The compression means 8 preferably also comprise retaining means 10 acting on opposite lateral edges 9*b*, 9*c* of the pressure belt 9. The retaining means 10 are configured to act on the pressure belt 9 in such a way as to give the active section 9*a* the above mentioned concave configuration.

The pressure belt 9 is slidably engaged with the retaining means 10.

Advantageously, the pressure belt 9 has a tangential speed that is synchronized with the rotation speed of the combining drum 6*a* so that the groups A do not rotate inside their respective flutes 6*b*. More specifically, the pressure belt 9 prevents the succession of connecting strips G from being rolled prematurely around the respective groups A, which would reduce the quality of the end product because the connecting strips G would not adhere to an optimum degree.

This could be achieved by configuring the pressure belt 9 in the form of a toothed belt (as illustrated in the accompanying drawings) driven in rotation by a power-driven toothed pulley 1. The teeth of the pressure belt 9 are made on the inside face of the pressure belt 9, opposite the face that comes into contact with the groups A provided with the connecting strips G (that is, the face opposite the active section 9*a*).

Alternatively, the pressure belt 9 is not power-driven and its rotation is imparted to it by the rotation of the nearby drums, including (for example) the combining drum 6*a*.

As shown in the accompanying drawings (in more detail in FIGS. 3A and 3B), the retaining means 10 comprise side guides 12*a* and 12*b*, disposed opposite each other and acting on opposite lateral edges 9*b*, 9*c* of the pressure belt 9. The side guides 12*a* and 12*b* are provided with respective guide walls 13*a* and 13*b*, which are curved or arcuate in shape and which are provided with convex zones disposed in supporting relation to the opposite lateral edges 9*b* and 9*c* of the pressure belt 9. In other words, the guide walls 13*a* and 13*b* are shaped in such a way as to allow the active section 9*a* of the pressure belt 9 to adapt to the aforementioned concave configuration defined between the second receiving station S2 and the release station S3. In other words, the guide walls exactly define the geometry (concavity) of the active section 9*a*.

Figure 3:
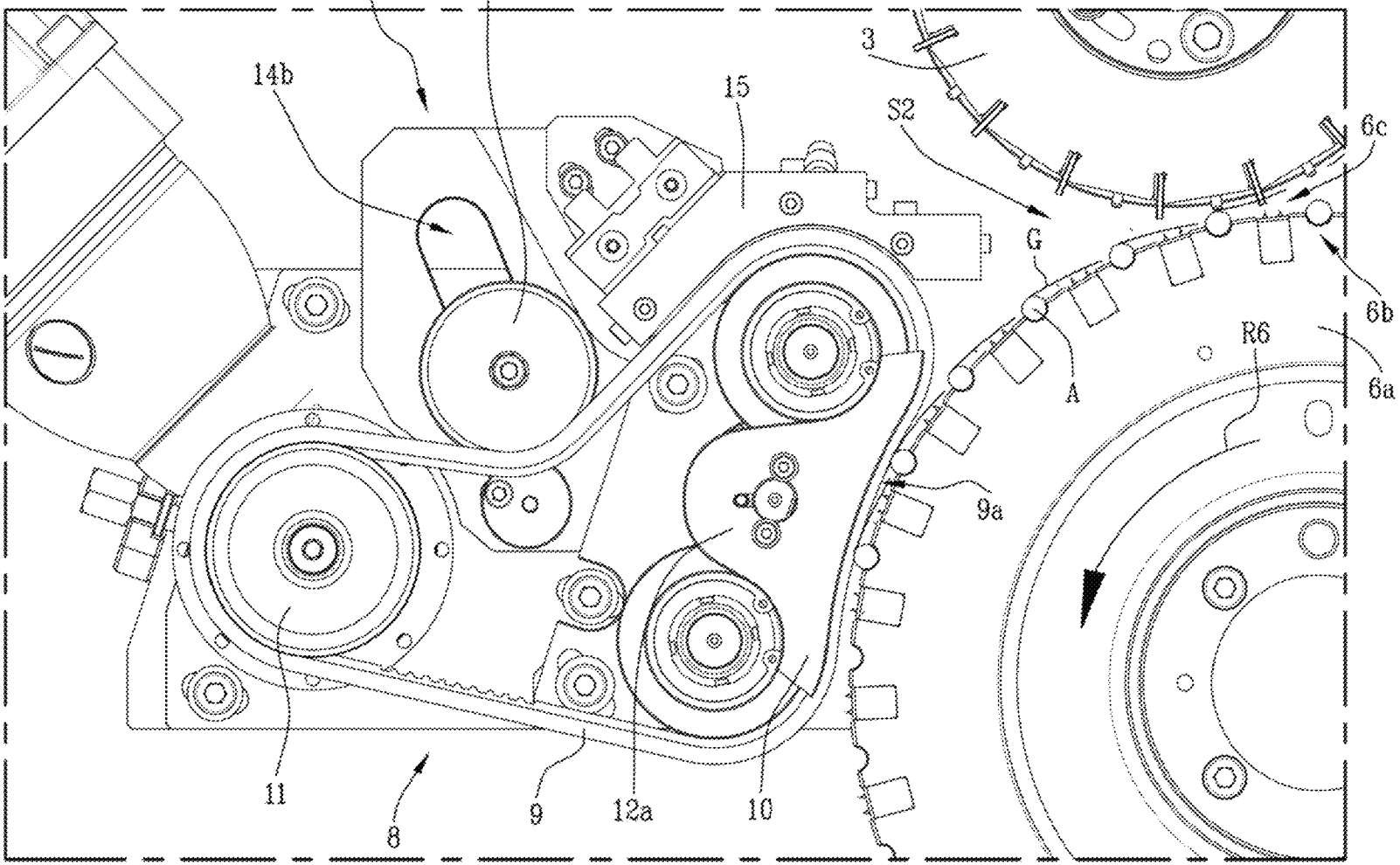
FIG. 3 shows a detail of the device of FIG. 2.
Figure 3A:
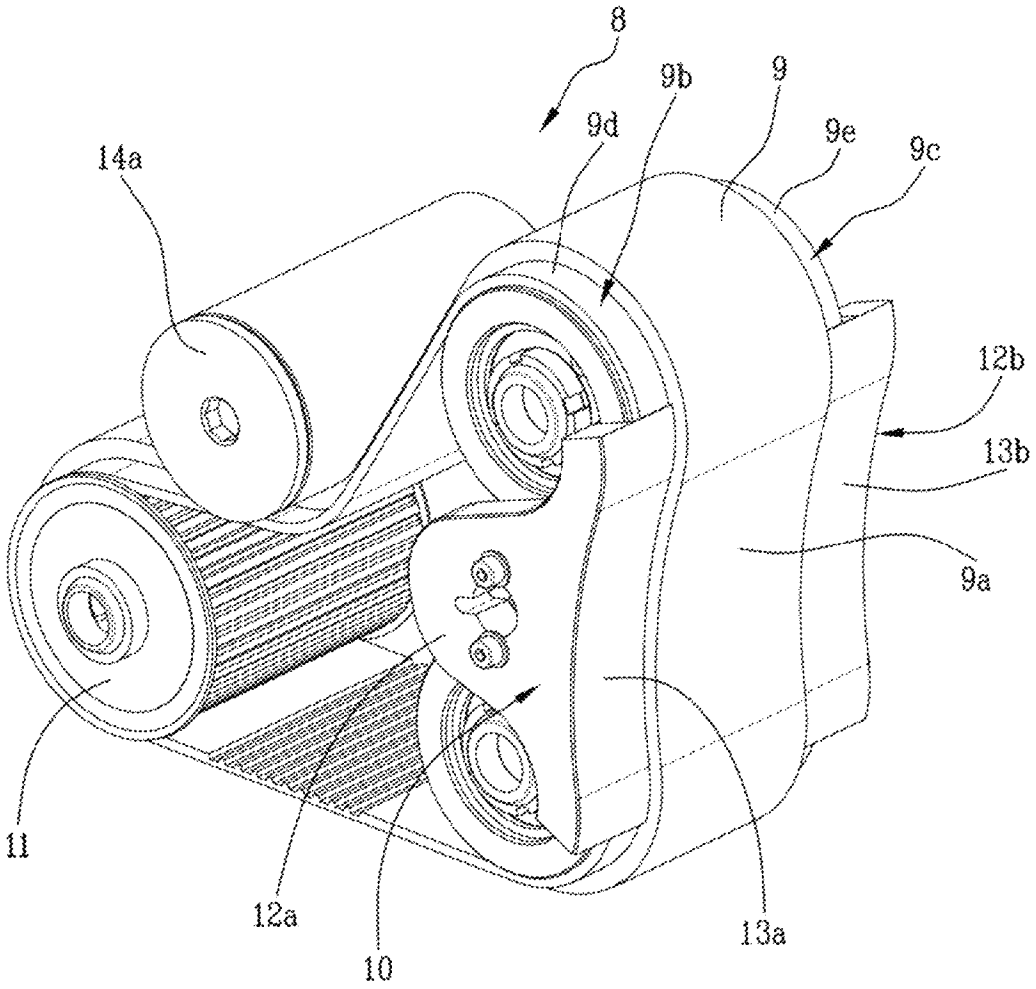
FIGS. 3A and 3B schematically represent an operating unit of the device of this invention.
Figure 3B:
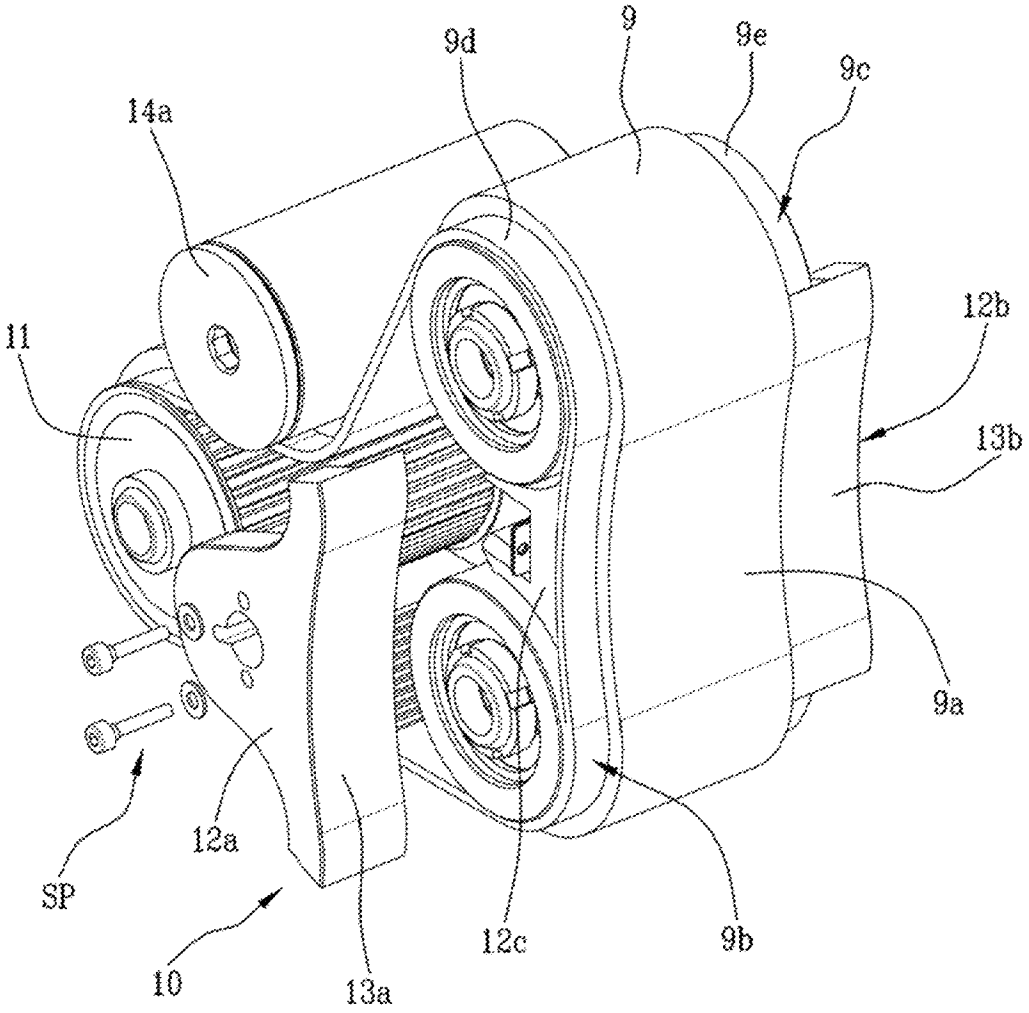

As clearly shown in FIGS. 3A and 3B, the pressure belt 9 is provided with lateral wings 9*d* and 9*e* which are reduced in thickness to engage the guide walls 13*a* and 13*b* in sliding contact relation. In other words, in this embodiment, the belt has a substantially T-shaped cross section. This solution advantageously allows operating locally on the portion of the groups A on which the connecting strip G is applied. In other words, in this solution, the overall width of the pressure belt 9 is less than or equal to the length of the filters F (or of the at least one filter F).

Figure 3C:
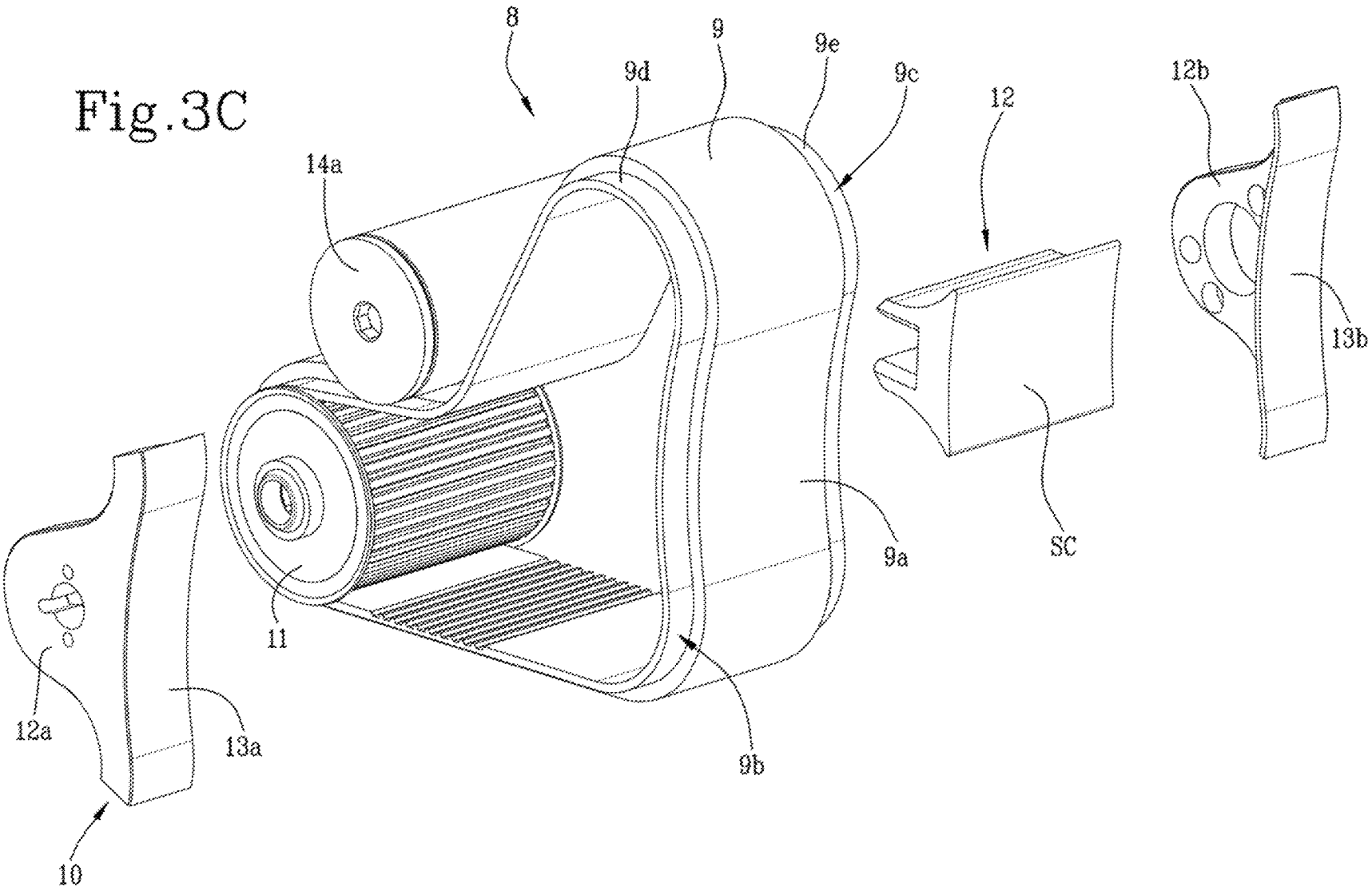
FIG. 3C illustrates a component of the operating unit of FIGS. 3A and 3B.

The retaining means 10 also comprise a guide member 12*c* interposed between the side guides 12*a*, 12*b*. Preferably, the side guides 12*a* and 12*b* are mounted on opposite faces of the guide member 12*c* and are removably connected to the guide member 12*c* by one or more fastening pins and/or threaded elements (schematically illustrated in FIG. 3B, where they are labelled SP in their entirety). The guide member 12*c* faces the convex side of the active section 9*a* of the pressure belt 9. In other words, the guide member 12*c* has a concave guide surface SC (shown in FIG. 3C) shaped to match the convex side of the active section 9*a*. The guide member 12*c* acts in sliding contact relation on the inside face of the pressure belt 9 (that is, the side opposite the side which presses against the groups A provided with the connecting strips G). This solution advantageously allows opposing the pressure exerted on the pressure belt 9 by the groups A. That way, it is advantageously possible to prevent the groups A from bending the pressure belt 9 in the direction orthogonal to the feed direction of the groups A themselves. The presence of the guide member 12*c* thus prevents the creation of an unwanted pressure condition (for example, uniform and rectilinear) on the groups A and to maintain the optimum concave geometry of the belt 9.

In the accompanying drawings, the compression means 8 are provided with tensioning means 14 adapted to keep the pressure belt 9 at a required tension. Preferably, the tensioning means 14 comprise a tensioning roller 14*a* and a guide 14*b* to allow it to be adjusted.

In an alternative embodiment of the retaining means 10, not illustrated, the retaining means comprise cam tracks acting in conjunction with rollers or cam follower elements mounted on opposite sides of the pressure belt 9, The rollers (or the cam follower elements) may be engaged with the teeth (if any) of the pressure belt 9 or with the main body of the belt. Thus, the cam tracks are shaped to follow the required profile defined by the trajectory of the groups A, between the second receiving station S2 and the release station S3. This solution allows obtaining the same result as that described above and illustrated in the accompanying drawings.

Figure 2:
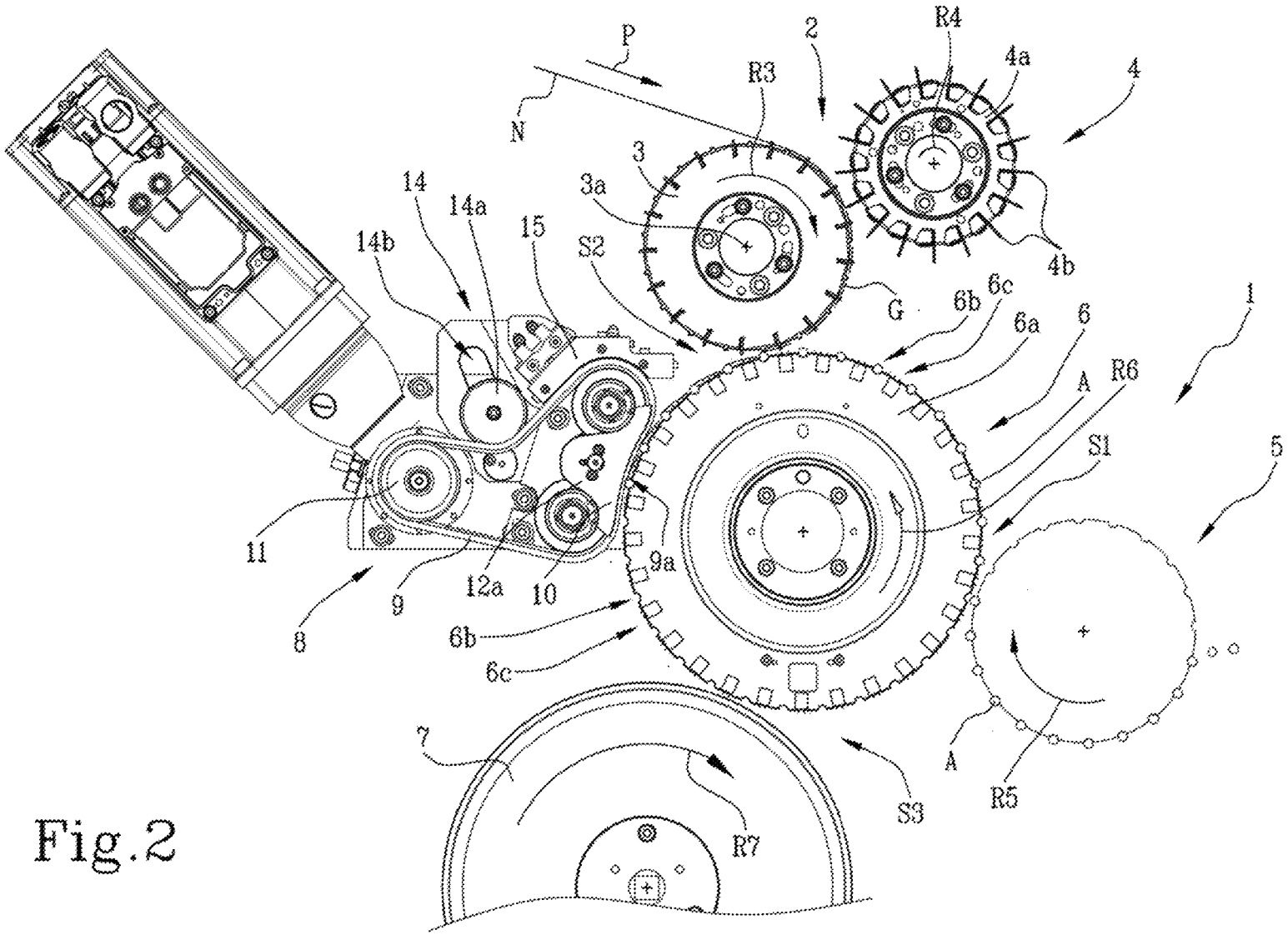
FIG. 2 schematically represents a second embodiment of a device for combining filter segments with cigarette rod segments.

FIG. 1 and FIG. 2 show two embodiments of this invention. The embodiment of FIG. 1 is a device 1 provided only with the compression means 8 described above. The embodiment of FIG. 2 is a device 1 where the compression means 8 also comprise a heater 15. The heater 15 is configured to heat the belt so as to improve the adhesion of each connecting strip G to the respective group A. The heater 15 may be made in the form of a heating shell or hood adapted to rub against the pressure belt 9 or to heat the belt 9 by irradiation or other contactless modes. Alternatively, the heater 15 is made in the form of one or more hot wheels resting on the pressure belt 9. Again alternatively, the heater 15 may coincide with the guide member 12*c*.

In the solution illustrated in FIGS. 2 and 3, the heater 15 advantageously allows improving the effect of impact between the connecting strip G and the group A by facilitating the drying of the glue.

Furthermore, the device 1 described above allows considerably increasing the length of time the connecting strip G is pressed against the group A. This strengthens the connection between the connecting strip G and the group A before they reach the portion of the rolling drum 7 where they are rolled together and where the cigarette rods B and the filters F are finally joined together.

This invention also relates to a method for combining at least a first segment B, specifically a cigarette rod segment B with at least a second segment F, specifically a filter segment F. This method of combining is implemented in a machine for making cigarettes S.

The method comprises a first step of making a succession of gummed connecting strips G. More specifically, the method comprises cutting a pre-gummed web N into separate gummed connecting strips G defining said succession. More specifically, the method comprises cutting the web N through cutting lines transverse to the web N itself.

The method also comprises feeding a succession of groups A, each comprising at least one cigarette rod segment B and one filter segment F abutted against each other end to end. The groups A may comprise two cigarette rod segments B which are coaxial with each other and separated by at least one double filter F. The method comprises feeding the groups A to a first receiving station S1 of a combining conveyor 6 like the one described above.

The method also comprises applying the succession of gummed connecting strips G in flag-like manner on respective groups A in a second receiving station S2 of the combining conveyor 6 downstream of the first receiving station S1. That way, the method allows joining the segment B to the segment F.

Next is a step of conveying the succession of groups A, each provided with a gummed connecting strip G, from the second receiving station S2 to a release station S3.

During this step, the method comprises a further step, called step of compressing, which involves compressing each group A with the respective gummed connecting strip G on it by means of compression means 8. This step comprises maintaining the compression along a predetermined trajectory from the second receiving station S2 to the release station S3.

More specifically, the method comprises compressing each group A with the respective gummed connecting strip G on it with a compression means 8 whose speed is synchronized with the combining conveyor 6 so as not to rotate the groups A in respective flutes of the combining conveyor 6.

The step of compressing is carried out preferably in such a way that the compression increases along the predetermined trajectory from the second receiving station S2 to the release station S3.

The step of compressing also comprises defining a compression channel of uniform width along a feed trajectory of the groups A. In other words, the method comprises setting up the compression means 8 and the combining conveyor 6 in such a way as to define said channel. Alternatively, the step of compressing comprises moving the compression means 8 non-synchronously.

The step of compressing may also include a step of heating the compression means 8 in order to improve adhesion of each connecting strip G to the respective group A.

Lastly, the method comprises a step of rolling the succession of gummed connecting strips G round the respective groups A so as to join together the segments making up each group A.

This invention achieves the preset aims, overcoming the disadvantages of the prior art by providing the user with a device 1 and a method for combining filter segments F with cigarette rod segments B in a machine for making cigarettes S and which are capable of guaranteeing a firm and secure connection between the filter segments F and the cigarette rod segments B.

The invention thus allows ensuring that the gummed connecting strips G are correctly applied on the respective groups A during subsequent rolling by ensuring that, once the connecting strips G have been associated with the groups A and are being transported, each connecting strip G does not come away from the respective group A and is not displaced from the required position.

The invention claimed is:

1. A device for combining filter segments with cigarette rod segments in a filter tip attachment machine for making cigarettes, comprising:

a first feed device including a suction surface and configured for feeding a succession of gummed connecting strips;

a second feed device including engagement flutes and configured for feeding a succession of groups, each comprising at least one cigarette rod segment and one filter segment abutted against each other end to end;

a combining conveyor configured to receive the succession of groups from the second feed device in a first receiving station and to receive the succession of gummed connecting strips from the first feed device in a second receiving station located downstream of the first receiving station so that each gummed connecting strip is applied in flag-like manner on a respective group to connect the cigarette rod segment to the filter segment;

a rolling drum which is coupled to the combining conveyor to receive from the combining conveyor, at a release station, a succession of groups, each provided with a gummed connecting strip applied in flag-like manner, and which is configured to roll the gummed connecting strip round the group;

a compression device operating in combination with the combining conveyor and acting downstream of the second receiving station and upstream of the release station, along a predetermined trajectory from the second receiving station to the release station, to produce compression between each group and the respective connecting strip applied in flag-like manner;

wherein the combining conveyor is configured as a combining drum comprising a peripheral mantle including a plurality of suction flutes for receiving respective groups and a plurality of support sections, alternated with successive ones of the suction flutes, for supporting free portions of the respective gummed connecting strips applied in flag-like manner;

wherein the compression device comprises a pressure belt having an active section which faces the peripheral mantle of the combining drum and is configured to keep each gummed connecting strip pressed against the respective group through a specified arc of rotation of the combining drum;

wherein the active section of the pressure belt has a concave configuration whose concavity faces the peripheral mantle of the combining drum and defines, in conjunction with the peripheral mantle, a compression channel through which each group, with a connecting strip applied in flag-like manner, passes.

2. The device according to claim 1, wherein the compression channel is uniform in width along a feed trajectory of the groups on the combining drum.

3. The device according to claim 1, wherein the compression channel decreases in width along a feed trajectory of the groups on the combining drum.

4. The device according to claim 1, wherein the compression device comprises a retaining device having surfaces acting on opposite lateral edges of the pressure belt to give the active section the concave configuration.

5. The device according to claim 4, wherein the pressure belt is slidably engaged with the retaining device.

6. The device according to claim 4, wherein the retaining device comprises side guides, opposite each other, provided with respective curved or arcuate guide walls having convex zones acting in sliding contact relation on the opposite lateral edges of the belt, the guide walls including the surfaces.

7. The device according to claim 6, wherein the pressure belt includes lateral wings which are reduced in thickness as compared to a central portion of the pressure belt to engage the guide walls.

8. The device according to claim 6, wherein the retaining device also comprises a guide member interposed between the side guides and facing a convex side of the active section of the pressure belt, the guide member having a concave guide surface that is shaped to match the convex side of the active section.

9. The device according to claim 8, wherein the side guides are mounted on opposite faces of the guide member and are removably connected to the guide member by one or more fastening pins and/or threaded elements.

10. The device according to claim 4, wherein the retaining device comprises cam tracks acting in conjunction with cam follower elements or rollers mounted on opposite sides of the pressure belt.

11. The device according to claim 1, wherein the pressure belt is a toothed pulley driven in rotation by a power-driven toothed pulley to keep a feed speed of the pressure belt synchronous with a rotation speed of the combining drum.

12. The device according to claim 1, wherein an angle of the arc is between 10° and 160°.

13. The device according to claim 1, wherein the compression device also comprises a heater configured to heat the pressure belt to improve adhesion of each gummed connecting strip to the respective group.

14. A filter tip attachment machine in a plant for making cigarettes or the like, comprising the device according to claim 1.

15. The device according to claim 1, wherein an angle of the arc is about 40°.

16. A method for combining at least a cigarette rod segment with at least a filter segment in a filter tip attachment machine for making cigarettes, comprising the following steps:

providing:

a device for combining filter segments with cigarette rod segments in a filter tip attachment machine for making cigarettes, comprising:

first feed device configured for feeding a succession of gummed connecting strips;

second feed device configured for feeding a succession of groups, each comprising at least one cigarette rod segment and one filter segment abutted against each other end to end;

a combining conveyor configured to receive the succession of groups from the second feed device in a first receiving station and to receive the succession of gummed connecting strips from the first feed device in a second receiving station located downstream of the first receiving station so that each gummed connecting strip is applied in flag-like manner on a respective group to connect the cigarette rod segment to the filter segment;

a rolling drum which is coupled to the combining conveyor to receive from the combining conveyor, at a release station, a succession of groups, each provided with a gummed connecting strip applied in flag-like manner, and which is configured to roll the gummed connecting strip round the group;

a compression device associated with the combining conveyor and acting downstream of the second receiving station and upstream of the release station, along a predetermined trajectory from the second receiving station to the release station, to produce compression between each group and the respective connecting strip applied in flag-like manner;

wherein the combining conveyor is configured as a combining drum comprising a peripheral mantle including a plurality of suction flutes for receiving respective groups and a plurality of support sections, alternated with successive ones of the suction flutes, for supporting free portions of the respective gummed connecting strips applied in flag-like manner;

wherein the compression device comprises a pressure belt having an active section which faces the peripheral mantle of the combining drum and is configured to keep each gummed connecting strip pressed against the respective group through a specified arc of rotation of the combining drum;

wherein the active section of the pressure belt has a concave configuration whose concavity faces the peripheral mantle of the combining drum and defines, in conjunction with the peripheral mantle, a compression channel through which each group, with a connecting strip applied in flag-like manner, passes;

feeding a succession of gummed connecting strips;

feeding a succession of groups, each comprising at least a first segment, specifically a cigarette rod segment with at least a second segment, specifically a filter segment, abutted against each other end to end, towards a first receiving station of a combining conveyor provided with suction flutes for accommodating respective groups;

applying each of the gummed connecting strips in flag-like manner on a respective group in a second receiving station of the combining conveyor downstream of the first receiving station, so as to connect the first segment to at least one second segment;

conveying a succession of groups, each provided with a gummed connecting strip from the second receiving station to a release station;

rolling the succession of gummed connecting strips round the respective groups;

compressing, by the compression device, each group with the respective gummed connecting strip attached thereto and maintaining the compression along a predetermined trajectory from the second receiving station to the release station.

17. The method according to claim 16, wherein the step of compressing is accomplished by producing compression between each group and the respective gummed connecting strip with the compression device whose speed is synchronized with the combining conveyor so as to prevent the groups from rotating in the respective suction flutes of the combining conveyor.

18. The method according to claim 16, wherein the step of compressing is carried out such that the compression remains constant along an entire predetermined trajectory from the second receiving station to the release station.

19. The method according to claim 16, wherein the step of compressing is carried out such that the compression increases along the predetermined trajectory from the second receiving station to the release station.

20. The method according to claim 16, wherein the step of compressing comprises a step of heating the compression device to improve adhesion of each gummed connecting strip to the respective group.

21. A device for combining filter segments with cigarette rod segments in a filter tip attachment machine for making cigarettes, comprising:

a first feed device including a suction surface and configured for feeding a succession of gummed connecting strips;

a second feed device including engagement flutes and configured for feeding a succession of groups, each comprising at least one cigarette rod segment and one filter segment abutted against each other end to end;

a combining conveyor configured to receive the succession of groups from the second feed device in a first receiving station and to receive the succession of gummed connecting strips from the first feed device in a second receiving station located downstream of the first receiving station so that each gummed connecting strip is applied in flag-like manner on a respective group to connect the cigarette rod segment to the filter segment;

a rolling drum which is coupled to the combining conveyor to receive from the combining conveyor, at a release station, a succession of groups, each provided with a gummed connecting strip applied in flag-like manner, and which is configured to roll the gummed connecting strip round the group;

a compression device operating in combination with the combining conveyor and acting downstream of the second receiving station and upstream of the release station, along a predetermined trajectory from the second receiving station to the release station, to produce compression between each group and the respective connecting strip applied in flag-like manner;

wherein the combining conveyor is configured as a combining drum comprising a peripheral mantle including a plurality of suction flutes for receiving respective groups and a plurality of support sections, alternated with successive ones of the suction flutes, for supporting free portions of the respective gummed connecting strips applied in flag-like manner;

wherein the compression device comprises a pressure belt having an active section which faces the peripheral mantle of the combining drum and is configured to keep each gummed connecting strip pressed against the respective group through a specified arc of rotation of the combining drum;

wherein the compression device also comprises a heater configured to heat the pressure belt to improve adhesion of each gummed connecting strip to the respective group.

* * * * *